US009626954B2

(12) United States Patent
Yano

(10) Patent No.: US 9,626,954 B2
(45) **Date of Patent: *Apr. 18, 2017**

(54) ACTIVE VIBRATION/NOISE CONTROL APPARATUS

(71) Applicant: Atsuyoshi Yano, Chiyoda-ku (JP)

(72) Inventor: Atsuyoshi Yano, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/759,303

(22) PCT Filed: Feb. 20, 2013

(86) PCT No.: PCT/JP2013/054147

§ 371 (c)(1),
(2) Date: Jul. 6, 2015

(87) PCT Pub. No.: WO2014/128856

PCT Pub. Date: Aug. 28, 2014

(65) Prior Publication Data

US 2015/0356966 A1 Dec. 10, 2015

(51) Int. Cl.
*G10K 11/178* (2006.01)

(52) U.S. Cl.
CPC ..... *G10K 11/178* (2013.01); *G10K 2210/129* (2013.01)

(58) Field of Classification Search
CPC ..... G10K 11/178; G10K 11/1788; G10K 2210/1291; G10K 2210/3028;
(Continued)

(56) References Cited

U.S. PATENT DOCUMENTS 5,727,073 A * 3/1998 Ikeda ..... H03H 21/0012 375/346
6,917,389 B2 * 7/2005 Lee ..... H04N 5/38 348/193
(Continued)

FOREIGN PATENT DOCUMENTS

JP 3-178845 A 8/1991
JP 4-11536 A 1/1992
(Continued)

OTHER PUBLICATIONS

U.S. Appl. No. 14/760,061, filed Jul. 9, 2015, Yano.
International Search Report issued May 28, 2013, in PCT/JP2013/054147, filed Feb. 20, 2013.

*Primary Examiner* — Akelaw Teshale
(74) *Attorney, Agent, or Firm* — Oblon, McClelland, Maier & Neustadt, L.L.P.

(57) ABSTRACT

A control signal filter 2 receives a sound source signal determined by a control frequency specified in conformity with the vibration/noise source that produces vibration/noise, and outputs a control signal. A filter coefficient update unit 4 updates coefficients of the control signal filter 2 in response to a sound source signal and an error signal. A signal-to-interference ratio measuring unit 5 outputs a signal-to-interference ratio determined from the vibration/noise and the interference contained in the error signal in response to the control frequency and error signal. An update controller 6 adjusts an update step of the filter coefficient update unit 4 in accordance with the signal-to-interference ratio.

10 Claims, 5 Drawing Sheets

(58) Field of Classification Search
CPC ... G10K 2210/121; G10K 2210/30391; G10K 2210/503; H04M 11/062; H04R 25/453; H04R 25/505
USPC ... 381/71.4, 58, 71.1, 71.11, 71.8, 312, 314, 381/83, 93, 94.7
See application file for complete search history.

(56) References Cited

U.S. PATENT DOCUMENTS

| | | | | |
|---|---|---|---|---|
| 2011/0222698 | A1* | 9/2011 | Asao | G10K 11/1784 381/71.1 |
| 2011/0305347 | A1* | 12/2011 | Wurm | G10K 11/178 381/71.1 |
| 2012/0063336 | A1* | 3/2012 | Shany | H04B 7/0452 370/252 |
| 2014/0032044 | A1* | 1/2014 | Watai | G05D 19/02 701/36 |

FOREIGN PATENT DOCUMENTS

| | | | |
|---|---|---|---|
| JP | 5-307393 | A | 11/1993 |
| JP | 7-219563 | A | 8/1995 |
| JP | 8-339192 | A | 12/1996 |
| JP | 2009-90756 | A | 4/2009 |
| JP | 2009-241672 | A | 10/2009 |

* cited by examiner

ACTIVE VIBRATION/NOISE CONTROL APPARATUS

TECHNICAL FIELD

The present invention relates to an active vibration/noise control apparatus for reducing vibration or noise produced by machinery, for example, by generating cancellation vibration or noise.

BACKGROUND ART

As a means for reducing vibration or noise which machinery produces, an active vibration control apparatus and an active noise control apparatus are known. Since the present invention is applicable to both of them, the instant specification refers to them as an active vibration/noise control apparatus collectively which means an "apparatus for controlling vibration or noise". Likewise, as for "vibration or noise" of machinery, they are referred to as vibration/noise collectively.

A conventional active vibration/noise control apparatus detects vibration or noise, which is a controlled subject, with a detector such as a vibration sensor or microphone, and controls it by outputting the same amplitude and anti-phase control signal for cancellation. As an example of such an active vibration/noise control apparatus, Patent Document 1, for example, discloses an active noise/vibration control apparatus that uses an adaptive notch filter. Here, if interference unrelated to the controlled subject is provided to the detector, the apparatus responds to it, and offers a problem of deviating the amplitude and phase of the control signal, thereby reducing suppression effect, or a problem of the apparatus itself of producing extraordinary vibration or a strange sound. As a concrete example of such interference, there is an impact or the sound of the impact caused by contact of a person or object with the vibration sensor, microphone or the body of the apparatus, or external sounds unrelated to the vibration/noise such as human voices input to the microphone.

Regarding such a problem, Patent Document 2, for example, discloses a method which decides, if the amplitude and the rate of change of the amplitude of the noise signal detected with the detector exceed a prescribed threshold, that it is an extraordinary input, and suppresses the change of the control signal. In addition, Patent Document 3 discloses a method which comprises a plurality of detecting means, and if it decides that only a single noise signal is equal to or greater than a threshold, it stops the control signal.

PRIOR ART DOCUMENT

Patent Document

Patent Document 1: Japanese Patent Laid-Open No. 8-339192/1996.

Patent Document 2: Japanese Patent Laid-Open No. 2009-241672.

Patent Document 3: Japanese Patent Laid-Open No. 2009-90756.

DISCLOSURE OF THE INVENTION

Problems to be Solved by the Invention

However, as for the method of the foregoing Patent Document 2, when the amplitude and the rate of change of the amplitude exceed prescribed thresholds owing to the changes of the vibration or noise itself of the controlled subject, it has a problem of temporarily impairing the noise reduction effect because it erroneously recognizes the vibration or noise as an extraordinary input and suppresses the change of the control signal. For example, although it is known that the noise of the engine varies owing to the load, the method of the Patent Document 2 has a danger of deciding that the vibration or noise is an extraordinary input even when the load increases suddenly and the noise increases. Originally, the noise reduction is necessary in such a case, and unless the apparatus achieves sufficient effect in this case, it is useless as a measure to counter noise. In view of this, if it tries to avoid this by increasing the threshold, another problem arises in that it is apt to overlook the extraordinary input to be prevented originally.

In addition, the method of the Patent Document 3 has a problem of being unable to detect such interference as the input to the plurality of detecting means at the same time. As for the noise control apparatus described in the Patent Document 3, although it is aimed at a car, since the interference such as door opening or shutting sound, for example, is input to all the detecting means (microphones) at the same time, it cannot detect such interference as interference, and cannot avoid malfunction of the noise control.

The present invention is implemented to solve the foregoing problems. Therefore it is an object of the present invention to provide an active vibration/noise control apparatus capable of detecting the extraordinary input positively without erroneously deciding that the vibration or noise is the extraordinary input even if it fluctuates, thereby offering stable vibration/noise reduction effect.

Means for Solving the Problems

An active vibration/noise control apparatus in accordance with the present invention comprises: a control signal filter that receives a sound source signal determined by control frequency specified in conformity with a vibration/noise source which produces vibration/noise, and that outputs a control signal; a filter coefficient updater that updates coefficients of the control signal filter in response to an error signal and the sound source signal, the error signal resulting from interference between the vibration/noise and secondary vibration/noise generated from the control signal; a signal-to-interference ratio measurer that determines the signal-to-interference ratio from the vibration/noise and interference contained in the error signal in response to the control frequency and the error signal, and outputs the signal-to-interference ratio; and an update controller that adjusts an update step of the filter coefficient updater in conformity with the signal-to-interference ratio.

Advantages of the Invention

The active vibration/noise control apparatus in accordance with the present invention is configured in such a manner as to adjust the update step of the filter coefficient updater in conformity with the signal-to-interference ratio calculated from the signal power of the residual vibration/noise signal corresponding to the control frequency component in the error signal and from the signal power of the interference signal corresponding to the frequency components other than the control signal. Accordingly, it can positively detect the vibration or noise without erroneously deciding it as the extraordinary input even if it fluctuates, thereby being able to detect the extraordinary input without fail and to carry out stable vibration/noise suppression.

BEST MODE FOR CARRYING OUT THE INVENTION

The best mode for carrying out the invention will now be described with reference to the accompanying drawings to explain the present invention in more detail.

Embodiment 1

Figure 1:
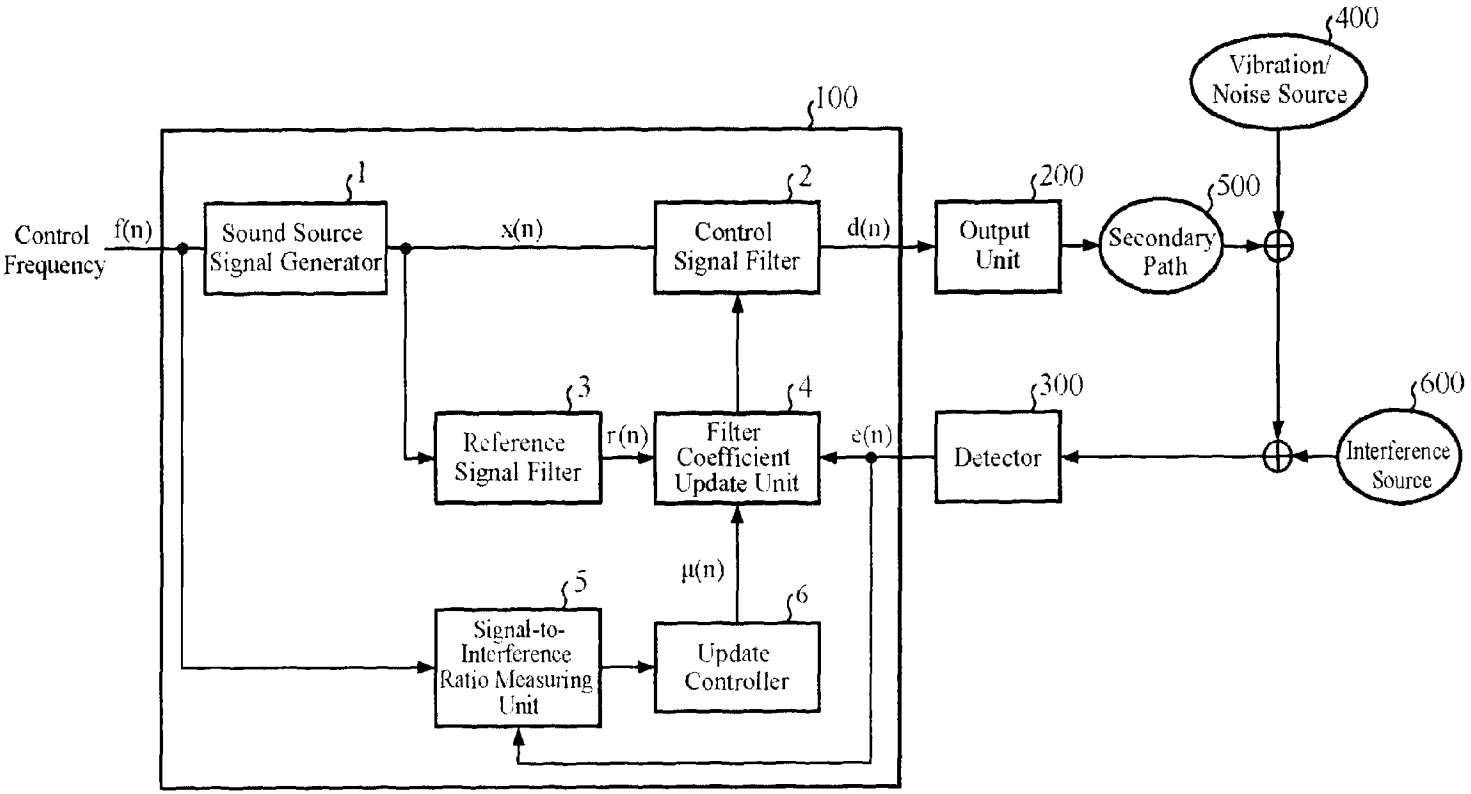
FIG. 1 is a block diagram showing a configuration of an active vibration/noise control apparatus of an embodiment 1 in accordance with the present invention.

FIG. 1 is a block diagram showing a configuration of an active vibration/noise control apparatus of an embodiment 1 in accordance with the present invention.

As shown in FIG. 1, the active vibration/noise control apparatus 100 of the embodiment 1 in accordance with the present invention is connected to an output device 200 and a detector 300, which are placed outside the apparatus.

The active vibration/noise control apparatus 100 receives control frequency based on the frequency of the vibration/noise of a vibration/noise source 400 which is a controlled subject, and outputs a control signal produced in response to the input control frequency. Here, if the vibration/noise source is the engine of a car, for example, the control frequency is obtained by a method that measures the rotational frequency of the engine from an ignition pulse period, followed by making constant times the rotational frequency in accordance with the engine rotational order of the target vibration/noise. In addition, if the vibration/noise source is a fan driven by an electric motor, the frequency of the target NZ noise can be obtained from the number of poles of the motor, the power supply frequency and the number of blades of the fan. In this way, as for the acquisition of the control frequency, a method appropriate to the target vibration/noise source can be used properly.

The output device 200 is one that converts the control signal supplied from the active vibration/noise control apparatus 100 to secondary vibration/noise for canceling the vibration/noise produced from the vibration/noise source 400 and outputs the secondary vibration/noise, and can be implemented by a speaker or an actuator. The secondary vibration/noise produced from the output device 200 is propagated through a secondary path 500, interferes with the vibration/noise produced from the vibration/noise source 400, and reduces the vibration/noise. Here, the secondary path 500 is defined as a path through which the secondary vibration/noise produced from the output device 200 is propagated up to the detector 300. In addition, an interference source 600 is one that further adds unspecific interference unrelated to the vibration/noise source 400 to the reduced vibration/noise.

The detector 300 is a device that detects an error which is residual vibration/noise produced by the interference between the secondary vibration/noise and the vibration/noise, and supplies the detected error to the active vibration/noise control apparatus 100 as an error signal e(n). It can be implemented by a microphone, a vibration sensor, an acceleration sensor or the like, for example.

Next, a detailed configuration of the active vibration/noise control apparatus 100 will be described. The active vibration/noise control apparatus 100 comprises a sound source signal generator 1, a control signal filter 2, a reference signal filter 3, a filter coefficient update unit 4, a signal-to-interference ratio measuring unit 5 and an update controller 6.

The sound source signal generator 1 is a signal generator that produces the sound source signal in response to the control frequency input to the active vibration/noise control apparatus 100. The sound source signal generator 1 supplies the sound source signal it produces to the control signal filter 2.

The control signal filter 2 is a filter that carries out filter processing of the sound source signal from the sound source signal generator 1, and outputs the control signal. Although the details thereof will be described later, the control signal is a signal to be converted to the secondary vibration/noise for reducing the vibration/noise.

The reference signal filter 3 is a filter that outputs the reference signal by carrying out the filter processing of the sound source signal from the sound source signal generator 1 by using the transfer characteristic parameters determined in accordance with the transfer characteristics of the secondary path 500. The reference signal filter 3 supplies the reference signal to the filter coefficient update unit 4.

The filter coefficient update unit 4 updates the filter coefficients of the control signal filter 2 using an adaptive algorithm such as an LMS (Least Mean Square) algorithm in accordance with the reference signal from the reference signal filter 3, the error signal from the detector 300 and the update step provided from the update controller 6 which will be described later.

The signal-to-interference ratio measuring unit 5 calculates the signal-to-interference ratio of the target vibration/noise contained in the error signal from the control frequency input to the active vibration/noise control apparatus 100 and from the error signal delivered from the detector 300, and supplies it to the update controller 6.

The update controller 6 determines the update step for updating the filter coefficients in accordance with the signal-to-interference ratio from the signal-to-interference ratio measuring unit 5, and supplies it to the filter coefficient update unit 4.

Next, the operation of the active vibration/noise control apparatus of the embodiment 1 will be described.

First, the control frequency f(n) representing the frequency of the vibration/noise is input to the sound source signal generator 1 in the active vibration/noise control apparatus 100. Here, n is a positive integer that designates the sampling time in the digital signal processing. The sound source signal generator 1 supplies the sound source signal x(n) corresponding to the control frequency f(n) to the control signal filter 2 and the reference signal filter 3. Here, when the active vibration/noise control apparatus 100 is one that uses an adaptive notch filter, for example, the sound source signal x(n) contains two types of signals, a sine signal and a cosine signal, corresponding to the control frequency f(n).

The control signal filter 2 carries out the filter processing of the sound source signal x(n) by using a control filter coefficient sequence W(n), and outputs the control signal d(n) to the output device 200. Here, the control filter coefficient sequence W(n) is a first-order or higher-order filter coefficient sequence. In addition, when the sound source signal x(n) includes the two types of signals, the sine signal and cosine signal, the control filter coefficient sequence W(n) is retained for the individual signals separately, and the control signal d(n) becomes the sum of the individual filter processing results.

The output device 200 converts the control signal d(n) output from the control signal filter 2 to the secondary vibration/noise and outputs it. The secondary vibration/noise output from the output device 200 is propagated through the secondary path 500, is affected by the transfer characteristics of the secondary path 500 during the process, and interferes with the vibration/noise produced from the vibration/noise source 400, thereby reducing the vibration/noise.

The reduced vibration/noise further receives the interference from the interference source 600.

The detector 300 detects the vibration/noise passing through the reduction followed by the addition of the interference, that is, the sum of the vibration/noise and the secondary vibration/noise and the interference, which is equal to the error with interference or the addition of the residual vibration/noise and the interference, and generates the error signal e(n). The error signal e(n) produced by the detector 300 is input to the filter coefficient update unit 4 in the active vibration/noise control apparatus 100.

On the other hand, the reference signal filter 3 carries out the filter processing of the sound source signal x(n) output from the sound source signal generator 1 using the reference filter coefficient sequence C with the transfer characteristics of the secondary path 500, and outputs the reference signal r(n). Here, the reference filter coefficient sequence C is a first-order or higher-order filter coefficient sequence. In addition, when the sound source signal x(n) includes the two types of signals, the sine signal and cosine signal, the reference filter coefficient sequence C is retained for the individual signals separately, and the reference signal r(n) contains the two types of signals which are the filter processing results of the individual signals.

In response to the reference signal r(n) output from the reference signal filter 3, the error signal e(n) output from the detector 300, and the update step μ(n) from the update controller 6, the filter coefficient update unit 4 sequentially updates the value of the control filter coefficient sequence W(n) of the control signal filter 2 so as to reduce the residual vibration/noise included in the error signal e(n).

The signal-to-interference ratio measuring unit 5 calculates the signal-to-interference ratio SIR(n) between the vibration/noise and the interference which are contained in the error signal e(n) in response to the control frequency f(n) and the error signal e(n). It obtains the SIR(n) from the ratio of the signal power of the control frequency f(n) to the signal power of the frequency components other than the control frequency f(n) in the error signal e(n).

Figure 2:
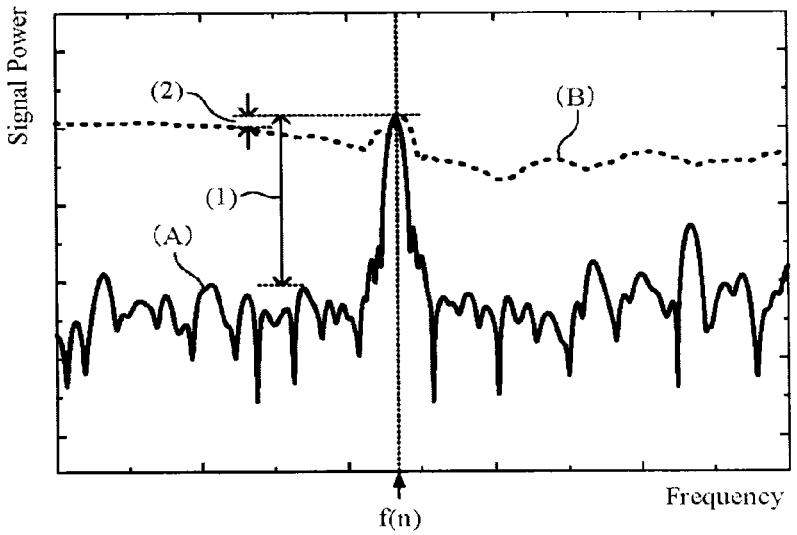
FIG. 2 is a diagram illustrating a power spectrum of an error signal of the active vibration/noise control apparatus of the embodiment 1 in accordance with the present invention.

FIG. 2 shows a power spectrum of the error signal e(n), in which the solid curve (A) represents an error signal e(n) that includes little interference, and a broken curve (B) represents a power spectrum that includes interference. As shown in the example of FIG. 2, since the signal-to-interference ratio that contains little interference ((1) in FIG. 2) is large, and the signal-to-interference ratio that contains interference ((2) in FIG. 2) is small, the presence or absence of the interference can be decided from the magnitude of the signal-to-interference ratio.

When calculating the signal-to-interference ratio SIR(n), as for the signal power of the residual vibration/noise with the control frequency f(n) and the signal power of the interference with the frequency components other than the control frequency f(n), the signal-to-interference ratio measuring unit 5 can measure them by extracting the signals with the respective frequency components from the error signal e(n) using a band-pass filter and a band-stop filter appropriately, and by obtaining the signal powers of the signals extracted. Alternatively, it can obtain them from a power spectrum computed by FFT (Fast Fourier Transform).

Incidentally, many of the adaptive algorithms the filter coefficient update unit 4 can use are more conspicuously susceptible to the interference as its frequency becomes closer to the control frequency f(n), and are more immune to the interference as the frequency becomes distant from the control frequency f(n). The LMS algorithm, for example, is one of such adaptive algorithms.

In this case, calculating the signal-to-interference ratio SIR(n) by assigning frequency weights, which decrease in accordance with the distance from the control frequency f(n), to the interference extracted from the error signal e(n), the signal-to-interference ratio measuring unit 5 can prevent excessive suppression of the coefficient update for the interference with remote enough frequency that has little influence on the adaptive algorithm.

Figure 3:
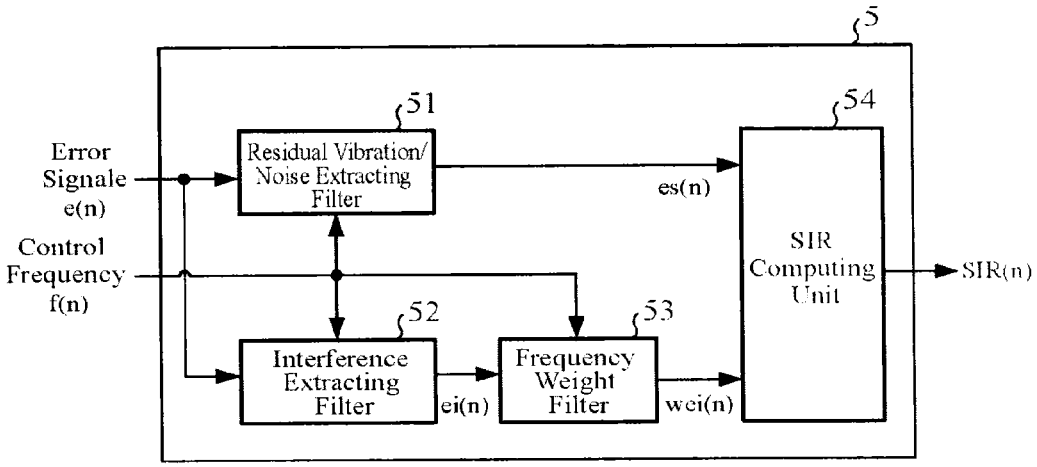
FIG. 3 is a block diagram showing a configuration of a signal-to-interference ratio measuring unit in the active vibration/noise control apparatus of the embodiment 1 in accordance with the present invention.

FIG. 3 shows a configuration of the signal-to-interference ratio measuring unit 5 that employs such a calculation method of the signal-to-interference ratio. It comprises a residual vibration/noise extracting filter 51, an interference extracting filter 52, a frequency weight filter 53 and an SIR computing unit 54.

Figure 4:
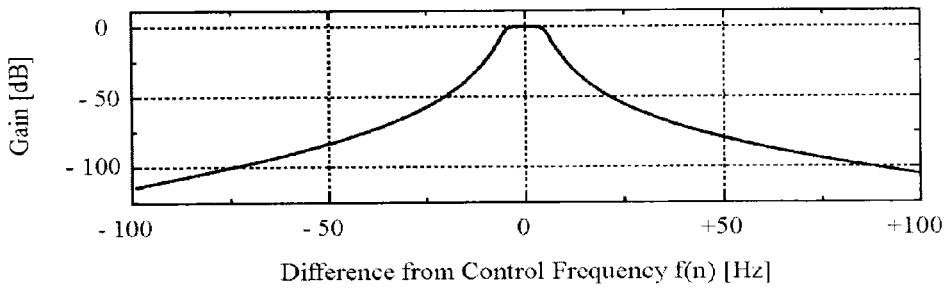
FIG. 4 is a diagram illustrating an example of frequency versus gain characteristics of a residual vibration/noise extracting filter in the active vibration/noise control apparatus of the embodiment 1 in accordance with the present invention.

The residual vibration/noise extracting filter 51 is a filter that receives the control frequency f(n) and the error signal e(n), extracts from the error signal e(n) the residual vibration/noise of the control frequency f(n) which is the remainder of the vibration/noise, and outputs the residual vibration/noise signal es(n). Such a filter can be implemented with a band-pass filter whose center frequency is the control frequency f(n), for example. As an example of such a residual vibration/noise extracting filter 51, FIG. 4 is a graph illustrating its frequency versus gain characteristics when implementing it with a four-order Butterworth filter with the pass-band width of 10 Hz.

Figure 5:
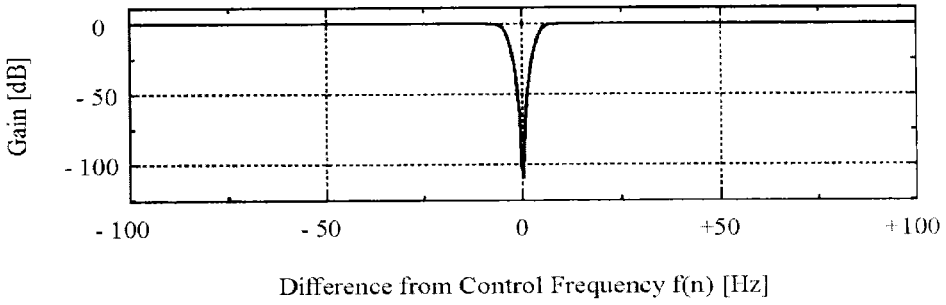
FIG. 5 is a diagram illustrating an example of frequency versus gain characteristics of an interference extracting filter in the active vibration/noise control apparatus of the embodiment 1 in accordance with the present invention.

The interference extracting filter 52 is a filter that receives the control frequency f(n) and the error signal e(n), extracts from the error signal e(n) the interference which is the signal components other than the residual vibration/noise of the control frequency f(n), and outputs the interference signal ei(n). Such a filter can be realized with a band-stop filter with the rejection band of the control frequency f(n), for example. As an example of such an interference extracting filter 52, FIG. 5 is a graph illustrating its frequency versus gain characteristics when implementing it with a four-order Butterworth filter with the rejection bandwidth of 10 Hz.

Figure 6:
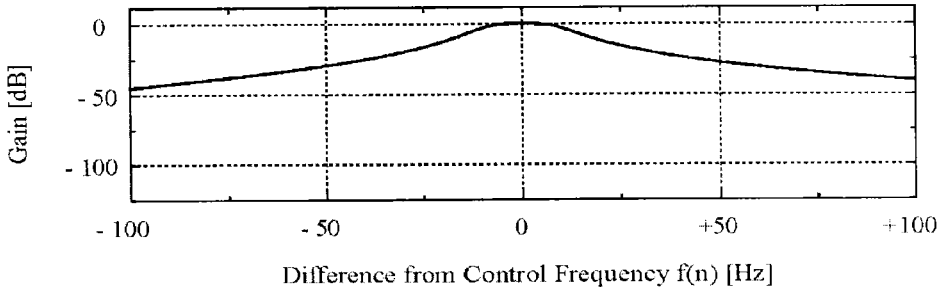
FIG. 6 is a diagram illustrating an example of frequency versus gain characteristics of a frequency weight filter in the active vibration/noise control apparatus of the embodiment 1 in accordance with the present invention.

The frequency weight filter 53 is a filter that receives the control frequency f(n) and the interference signal ei(n) from the interference extracting filter 52, assigns prescribed frequency weights to the interference signal ei(n), and outputs a weighted interference signal wei(n). The frequency characteristics of the frequency weight filter 53 is determined in accordance with the prescribed frequency weights. As for the frequency weights at this time, it is desirable to estimate the interference that has much effect on the adaptive algorithm to be heavy, and the interference that has little effect to be light. As for a general adaptive algorithm, since it is more susceptible to the interference with the frequency closer to the control frequency f(n), it is conceivable to assign weights which have a maximum value at the control frequency f(n) and reduce their gain with the frequency distance from f(n), for example. As an example of such a frequency weight filter 53, FIG. 6 is a graph illustrating its frequency versus gain characteristics when designing it with a second-order Butterworth filter with a pass-bandwidth of 20 Hz.

The SIR computing unit 54 receives the residual vibration/noise signal es(n) from the residual vibration/noise extracting filter 51 and the weighted interference signal wei(n) from the frequency weight filter 53, calculates the signal-to-interference ratio SIR(n) from them, and outputs it to the signal-to-interference ratio measuring unit 5. The SIR(n) can be obtained as follows, for example, from the residual vibration/noise signal power Pes(n) of the residual vibration/noise signal es(n) and from the weighted interference signal power Pwei(n) of the weighted interference signal wei(n).

$$\mathrm{SIR}(n)=Pes(n)/(Pwei(n)+Pes(n)) \tag{1}$$

where Pes(n) and Pwei(n) are given by the following Expressions, for example.

$$Pes(n)=(1-\alpha)Pes(n-1)+\alpha^{*}es^{2}(n) \tag{2}$$

$$Pwei(n)=(1-\alpha)Pwei(n-1)+\alpha^{*}wei^{2}(n) \tag{3}$$

where $\alpha$ is a prescribed averaging parameter satisfying the relationships $0<\alpha\leq 1$.

The update controller 6 determines the update step $\mu(n)$ in accordance with the signal-to-interference ratio SIR(n) from the signal-to-interference ratio measuring unit 5, and supplies it to the filter coefficient update unit 4. For example, when the signal-to-interference ratio measuring unit 5 obtains the SIR(n) according to the foregoing Expression (1), the SIR(n) takes a value from 0 to 1 in accordance with the magnitude of the signal power ratio of the residual vibration/noise to the interference. Accordingly, a method is conceivable which determines the update step $\mu(n)$ and supplies it to the filter coefficient update unit 4 as the control information.

$$\mu(n)=\eta^{*}\mathrm{SIR}(n) \tag{4}$$

where $\eta$ is a prescribed constant value. As for the value $\eta$, it is desirable to set it at a value that will give the optimum update step in the condition of no interference, that is, SIR(n)=1.

In addition, a configuration is also possible which determines the prescribed threshold at a value that will prevent the apparatus from being affected even if it receives a particularly strong interference, and stops updating the coefficients by setting at $\mu(n)=0$ when the SIR(n) is less than the threshold.

As described above, according to the active vibration/noise control apparatus of the embodiment 1 in accordance with the present invention, it comprises the control signal filter that receives the sound source signal determined by control frequency specified in conformity with the vibration/noise source which produces vibration/noise, and that outputs the control signal; the filter coefficient update unit that updates the coefficients of the control signal filter in response to the error signal and the sound source signal, the error signal resulting from the interference between the vibration/noise and the secondary vibration/noise generated from the control signal; the signal-to-interference ratio measuring unit that determines the signal-to-interference ratio from the vibration/noise and interference contained in the error signal in response to the control frequency and the error signal, and outputs the signal-to-interference ratio; and the update controller that adjusts the update step of the filter coefficient update unit in conformity with the signal-to-interference ratio. Accordingly, it offers an advantage of being able to prevent the vibration/noise from being erroneously detected as the interference even if its power fluctuates sharply, and to maintain the stable vibration/noise reduction effect.

In addition, according to the active vibration/noise control apparatus of the embodiment 1, the signal-to-interference ratio measuring unit is configured in such a manner as to calculate the signal-to-interference ratio from the residual vibration/noise signal power with the control frequency in the error signal and the interference signal power with at least one frequency or frequency band that differs from the control frequency in the error signal. Accordingly, it offers an advantage of being able to prevent the vibration/noise from being erroneously detected as the interference even if its power fluctuates sharply, and to maintain the stable vibration/noise reduction effect.

In addition, according to the active vibration/noise control apparatus of the embodiment 1, the signal-to-interference ratio measuring unit is configured in such a manner as to assign the prescribed frequency weights to the components of the signal or the interference signal power in the frequency band except for the control frequency in the error signal. Accordingly, it offers an advantage of being able to prevent the vibration/noise from being erroneously detected as the interference even if its power fluctuates sharply, and to maintain the stable vibration/noise reduction effect.

In addition, according to the active vibration/noise control apparatus of the embodiment 1, the signal-to-interference ratio measuring unit is configured in such a manner as to comprise the residual vibration/noise extracting filter that extracts the residual vibration/noise signal with the control frequency from the error signal; and the interference extracting filter that extracts the interference signal with the frequency band except for the control frequency from the error signal. Accordingly, it offers an advantage of being able to prevent the vibration/noise from being erroneously detected as the interference even if its power fluctuates sharply, and to maintain the stable vibration/noise reduction effect.

In addition, according to the active vibration/noise control apparatus of the embodiment 1, the signal-to-interference ratio measuring unit is configured in such a manner as to comprise the frequency weight filter that assigns prescribed frequency weights to the interference signal. Accordingly, it offers an advantage of being able to prevent the vibration/noise from being erroneously detected as the interference even if its power fluctuates sharply, and to maintain the stable vibration/noise reduction effect.

In addition, according to the active vibration/noise control apparatus of the embodiment 1, the frequency weights are provided with the characteristics that attenuate in accordance with the distance from the control frequency. Accordingly, as for the interference that has frequency components distant from the vibration/noise and hence has little effect on the active vibration/noise control apparatus, it offers an advantage of being able to prevent the excessive suppression of the filter coefficients, and to maintain the stable vibration/noise reduction effect.

In addition, according to the active vibration/noise control apparatus of the embodiment 1, the update controller is configured in such a manner as to determine the update step at a larger value as the signal-to-interference ratio increases and at a smaller value as the signal-to-interference ratio decreases. Accordingly, it offers an advantage of being able to increase the vibration/noise reduction effect when the interference is small, and to increase the stability of the operation when the interference is large.

In addition, according to the active vibration/noise control apparatus of the embodiment 1, the update controller is configured in such a manner as to determine the update step at zero when the signal-to-interference ratio determined from the vibration/noise and the interference which are contained in the error signal is less than the prescribed threshold. Accordingly, even if excessively large interference is input, it offers an advantage of being able to prevent the malfunction of the apparatus, and to maintain the stable vibration/noise reduction effect.

Embodiment 2

In the embodiment 1 in accordance with the present invention, as a method for calculating the signal-to-interference ratio SIR(n), the method is described for measuring the signal power of the residual vibration/noise signal es(n) and that of the interference signal ei(n) in the error signal e(n) using the band-pass filter or band-stop filter or the power spectrum analysis by the FFT, and for calculating the signal-to-interference ratio SIR(n).

However, depending on the vibration/noise source, there are some that change the frequency of the vibration/noise frequently owing to the variation of a rotation rate like a car engine, for example. In such a case, the method using the band-pass filter or band-stop filter must alter the frequency characteristics of the filter in accordance with the frequency of the vibration/noise, which requires frequent redesign of the filter and increases the computation amount of the processor. In addition, when the filter is composed of an IIR (Infinite Impulse Response) filter, there are fears that dynamic changes of the filter coefficients can incur unstable behavior such as divergence of the output signal.

When using the power spectrum analysis by the FFT, although the problems such as an increase in the computation amount and instability due to the redesign of the filters as described above do not occur, a problem arises of reducing the measuring accuracy of the signal-to-interference ratio. Namely, when the vibration/noise varies within a time window of the FFT, the frequency components of the vibration/noise spread to all the frequency bands through which the vibration/noise passes on the power spectrum, and this makes it difficult to separate the vibration/noise from the interference to measure the signal power. Although narrowing the time window of the FFT enables increasing the time resolution, the frequency resolution reduces by that amount, and the overall measurement accuracy deteriorates.

In such a case, using an adaptive notch filter enables measuring the signal power of the vibration/noise and that of the interference at the frequency near the vibration/noise whose frequency varies, and obtaining the signal-to-interference ratio without involving the foregoing problems. As an example of a configuration in such a case, an active vibration/noise control apparatus of an embodiment 2 in accordance with the present invention will be described.

Figure 7:
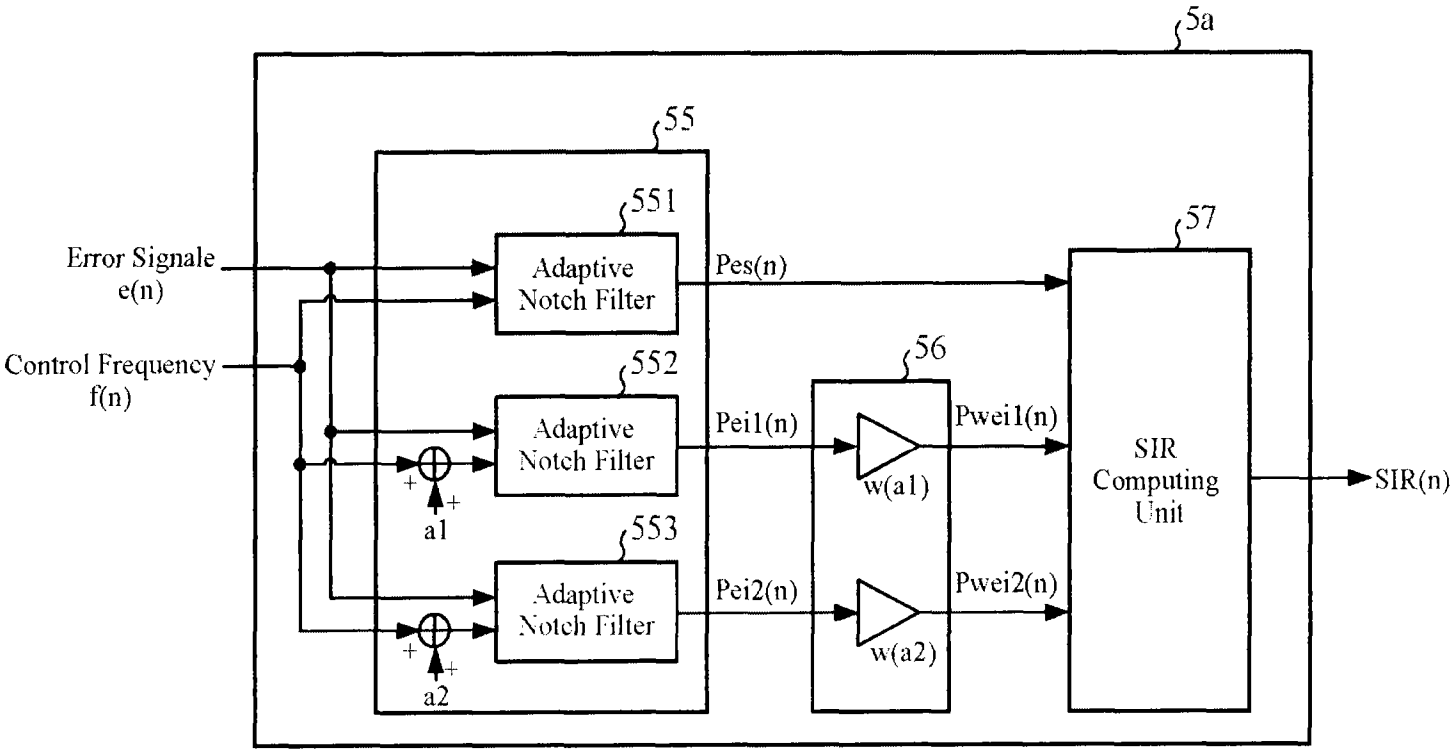
FIG. 7 is a block diagram showing a configuration of the signal-to-interference ratio measuring unit of an active vibration/noise control apparatus of an embodiment 2 in accordance with the present invention.

Referring to the drawings, the embodiment 2 in accordance with the present invention will be described. FIG. 7 shows a signal-to-interference ratio measuring unit 5*a* of the active vibration/noise control apparatus of the embodiment 2 in accordance with the present invention. Incidentally, since the other components are the same as those of FIG. 1, their description will be omitted.

The signal-to-interference ratio measuring unit 5*a* of FIG. 7 comprises an adaptive notch filter group 55, a frequency weighting unit 56, and an SIR computing unit 57.

The adaptive notch filter group 55 is comprised of a plurality of, at least two, adaptive notch filters. Although FIG. 7 shows an example in which the adaptive notch filter group 55 has three adaptive notch filters, a first adaptive notch filter 551, a second adaptive notch filter 552 and a third adaptive notch filter 553, the number of the adaptive notch filters constituting the adaptive notch filter group 55 of the present invention is not limited to that.

When the adaptive notch filter group 55 receives the control frequency f(n) and the error signal e(n) input to the signal-to-interference ratio measuring unit 5*a*, it measures and outputs the residual vibration/noise signal power Pes(n) of the control frequency f(n), the first interference signal power Pei1(*n*) and second interference signal power Pei2(*n*) of the frequency near the control frequency f(n). Thus, one of the adaptive notch filters of the adaptive notch filter group 55 is used for measuring the signal power of the residual vibration/noise, and the other filters are used for measuring the signal power of the interference.

The frequency weighting unit 56 assigns weights to the first interference signal power Pei1(*n*) and second interference signal power Pei2(*n*) the adaptive notch filter group 55 measures in accordance with the frequency distance from the control frequency f(n), and outputs the first weighted interference signal power Pwei1(*n*) and second weighted interference signal power Pwei2(*n*).

The SIR computing unit 57 calculates and outputs the signal-to-interference ratio SIR(n) in response to the residual vibration/noise signal power Pes(n), the first weighted interference signal power Pwei1(*n*), and the second weighted interference signal power Pwei2(*n*).

Next, the operation of the embodiment 2 in accordance with the present invention will be described with reference to FIG. 7.

When the adaptive notch filter group 55 receives the error signal e(n) and the control frequency f(n), the first adaptive notch filter 551 receives the error signal e(n) and the control frequency f(n) first. The first adaptive notch filter 551 measures the residual vibration/noise signal power Pes(n) of the signal component of the control frequency f(n) contained in the error signal e(n) and outputs it.

The second adaptive notch filter 552 receives the error signal e(n) and frequency f(n)+a1 resulting from addition of a prescribed frequency offset a1 to the control frequency f(n), measures the first interference power Pei1(*n*), and outputs it. Here, a1 is a predetermined offset value for measuring the signal power of the interference near the control frequency f(n), and is assumed to take a positive or negative value other than zero.

Likewise, the third adaptive notch filter 553 receives the error signal e(n) and frequency f(n)+a2 resulting from addition of a prescribed frequency offset a2 to the control frequency f(n), measures the second interference power Pei2(*n*), and outputs it. Here, a2 is a predetermined offset value for measuring the signal power of the interference near the control frequency f(n), and is assumed to take a positive or negative value other than zero.

The frequency weighting unit 56 receives the first interference signal power Pei1(*n*) and the second interference signal power Pei2(*n*) from the adaptive notch filter group 55, multiplies them by weight coefficients w(a1) and w(a2) determined in accordance with the frequency offsets a1 and a2, and outputs the first weighted interference signal power Pwei1(*n*) and the second weighted interference signal power Pwei2(*n*). This yields $$Pwei1(n)=Pei(n)*w(a1)$$

$$Pwei2(n)=Pei(n)*w(a2) \quad (5)$$

where as for the weight coefficients w(a1) and w(a2), it is desirable to determine them in such a manner as to assign heavy weight to the interference having considerable influence on the adaptive algorithm, and to assign light weight to the interference having limited influence. Generally, since the interference with the frequency closer to the control frequency f(n) is likely to receive greater influence, characteristics are conceivable which reduce the weight as the absolute value of the frequency offsets a1 and a2 increase, for example.

The SIR computing unit 57 receives the residual vibration/noise signal power Pes(n) from the adaptive notch filter group 55, and the first weighted interference signal power Pwei1(*n*) and the second weighted interference signal power Pwei2(*n*) from the frequency weighting unit 56, calculates the signal-to-interference ratio SIR(n) from them, and outputs it. The signal-to-interference ratio SIR(n) can be calculated by the following Expression, for example.

$$\mathrm{SIR}(n)-Pes(n)/(Pwei1(n)+Pwei2(n)+Pes(n)) \quad (6)$$

Figure 8:
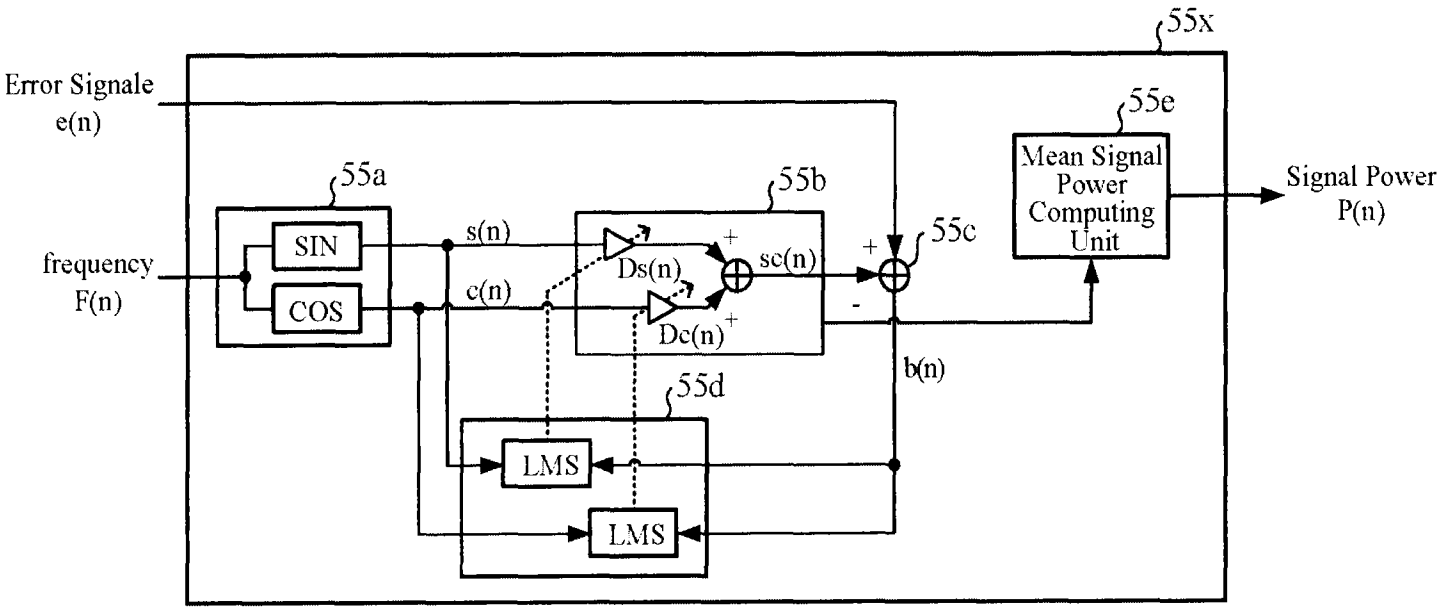
FIG. 8 is a block diagram showing a configuration of an adaptive notch filter in the active vibration/noise control apparatus of the embodiment 2 in accordance with the present invention.

Here, the adaptive notch filters in the adaptive notch filter group 55 differ only in their input and output, but all of them have the same configuration and operation. FIG. 8 is a block diagram showing a configuration of the adaptive notch filters. Referring to FIG. 8, the configuration and operation of the adaptive notch filters of the present invention will be described.

In FIG. 8, the adaptive notch filter 55*x* comprises a sine wave and cosine wave generator 55*a*, a single tap filter unit 55*b*, a subtractor 55*c*, a single tap filter coefficient update unit 55*d*, and a mean signal power computing unit 55*e*.

The sine wave and cosine wave generator 55*a*, receiving the frequency F(n) input to the adaptive notch filter 55*x*, outputs a sine s(n) and a cosine c(n) of the frequency F(n). Here, when the input frequency F(n) alters, the sine wave and cosine wave generator 55*a* varies the frequency of the sine s(n) and cosine c(n) in response to it.

The single tap filter unit 55*b* receives the sine s(n) and cosine c(n) from the sine wave and cosine wave generator 55*a*, multiplies the sine s(n) by a coefficient Ds(n) and the cosine c(n) by a coefficient Dc(n), followed by adding the results, and outputs a composite signal sc(n). Thus, $$sc(n)=Ds(n)s(n)+Dc(n)c(n) \quad (7)$$

The subtractor 55*c* receives the error signal e(n) input to the adaptive notch filter 55*x* and the composite signal sc(n) from the single tap filter unit 55*b*, subtracts the composite signal sc(n) from the error signal e(n), and outputs a residual signal b(n). Thus, $$b(n)=e(n)-sc(n) \quad (8)$$

The single tap filter coefficient update unit 55*d* receives the sine s(n) and cosine c(n) from the sine wave and cosine wave generator 55*a* and the residual signal b(n) from the subtractor 55*c*, and updates the coefficients Ds(n) and Dc(n) of the single tap filter coefficient update unit 55*d* in such a manner as to reduce the frequency F(n) component in the residual signal b(n). As for the coefficient update, an adaptive algorithm such as an LMS algorithm can be used. When using the LMS algorithm, the coefficient update is represented by the following Expressions.

$$Ds(n+1)=Ds(n)+\gamma*s(n)b(n)$$

$$Dc(n+1)=Dc(n)+\gamma*c(n)b(n) \quad (9)$$

where γ is a prescribed constant which determines the update step of the coefficients Ds(n) and Dc(n).

The mean signal power computing unit 55*e* reads the coefficients Ds(n) and Dc(n) of the single tap filter unit 55*b*, calculates the mean signal power P(n) of the frequency F(n) component contained in the error signal e(n) in response to the coefficients Ds(n) and Dc(n), and outputs it to the outside of the adaptive notch filter 55*x*. If the frequency F(n) component is almost eliminated from the residual signal b(n) by the operation of the single tap filter coefficient update unit 55*d*, the composite signal sc(n) becomes nearly equal to the frequency F(n) component of the error signal e(n). Accordingly, the signal power of the frequency F(n) component of the error signal e(n) can be calculated from the mean signal power P(n) of the composite signal sc(n). The mean signal power P(n) of the composite signal sc(n) is calculated from the coefficients Ds(n) and Dc(n) according to the following Expression.

$$P(n)=(1/\sqrt{2})(Ds^2(n)+Dc^2(n)) \quad (10)$$

Since the mean signal power P(n) of Expression (10) is successively calculated for the error signal e(n) and frequency F(n) input for each sampling, the mean signal power computing unit 55*e* can calculate the residual vibration/noise signal power and the interference signal power quickly in response to the new frequency even if the frequency of the vibration/noise varies, thereby being able to obtain the signal-to-interference ratio.

As described above, according to the active vibration/noise control apparatus of the embodiment 2 in accordance with the present invention, it is configured in such a manner as to calculate the residual vibration/noise signal power and the interference signal power in response to the coefficients of the adaptive notch filters that are adapted to the error signal. Accordingly, even if the frequency of the vibration/noise varies, it offers an advantage of being able to calculate the signal-to-interference ratio at the new frequency quickly, and to detect the interference accurately.

Incidentally, it is to be understood that a free combination of the individual embodiments, variations of any components of the individual embodiments or removal of any components of the individual embodiments is possible within the scope of the present invention.

INDUSTRIAL APPLICABILITY

As described above, an active vibration/noise control apparatus in accordance with the present invention generates the cancellation vibration or noise against the vibration or noise such as machinery produces to reduce the vibration or noise, and is suitable for reducing the vibration or noise of the engine of a car, for example.

DESCRIPTION OF REFERENCE SYMBOLS

1 sound source signal generator; 2 control signal filter; 3 reference signal filter; 4 filter coefficient update unit; 5 signal-to-interference ratio measuring unit; 6 update controller; 51 residual vibration/noise extracting filter; 52 interference extracting filter; 53 frequency weight filter; 54 SIR computing unit; 55 adaptive notch filter group; 55*a* sine wave and cosine wave generator; 55*b* single tap filter unit; 55*c* subtractor; 55*d* single tap filter coefficient update unit; 55*e* mean signal power computing unit; 55*x* adaptive notch filter; 56 frequency weighting unit; 57 SIR computing unit; 100 active vibration/noise control apparatus; 200 output unit; 300 detector; 400 vibration/noise source; 500 secondary path; 551 first adaptive notch filter; 552 second adaptive notch filter; 553 third adaptive notch filter; 600 interference source.

What is claimed is:

1. An active vibration or noise control apparatus comprising:

a control signal filter that receives a sound source signal determined from control frequency specified in conformity with a vibration or noise source which produces vibration or noise and that outputs a control signal;

a filter coefficient updater that updates coefficients of the control signal filter in response to an error signal and the sound source signal, the error signal resulting from interference between the vibration or noise and secondary vibration or noise generated from the control signal;

a signal-to-interference ratio measurer that determines a signal-to-interference ratio from the vibration or noise and interference contained in the error signal in response to the control frequency and the error signal, and outputs the signal-to-interference ratio; and an update controller that adjusts an update step of the filter coefficient updater in conformity with the signal-to-interference ratio.

2. The active vibration or noise control apparatus according to claim 1, wherein the signal-to-interference ratio measurer calculates the signal-to-interference ratio from residual vibration or noise signal power with the control frequency in the error signal and from interference signal power with at least one frequency or frequency band that differs from the control frequency in the error signal.

3. The active vibration or noise control apparatus according to claim 1; wherein the signal-to-interference ratio measurer calculates residual vibration or noise signal power from coefficients of an adaptive notch filter which is adapted to the error signal.

4. The active vibration or noise control apparatus according to claim 1, wherein the signal-to-interference ratio measurer calculates interference signal power from coefficients of an adaptive notch filter which is adapted to the error signal.

5. The active noise vibration or noise control apparatus according to claim 1, wherein the signal-to-interference ratio measurer assigns prescribed frequency weights to components of a signal or interference signal power in a frequency band except for the control frequency in the error signal.

6. The active vibration or noise control apparatus according to claim 1; wherein the signal-to-interference ratio measurer comprises:

a residual vibration or noise extracting filter that extracts residual vibration or noise signal with the control frequency from the error signal; and an interference extracting filter that extracts an interference signal with a frequency band except for the control frequency.

7. The active vibration or noise control apparatus according to claim 6, wherein the signal-to-interference ratio measurer comprises a frequency weight filter that assigns prescribed frequency weights to the interference signal.

8. The active vibration or noise control apparatus according to claim 5, wherein the frequency weights have characteristics that attenuate with distance from the control frequency.

9. The active vibration or noise control apparatus according to claim 1, wherein the update controller determines the update step at a larger value as the signal-to-interference ratio increases and at a smaller value as the signal-to-interference ratio decreases.

10. The active vibration or noise control apparatus according to claim 1, wherein the update controller determines the update step at zero when the signal-to-interference ratio determined from the vibration or noise and interference contained in the error signal is less than a prescribed threshold.

* * * * *